United States Patent [19]

Möder

[11] 4,027,641

[45] June 7, 1977

[54] CONTROL APPARATUS FOR STARTING INTERNAL COMBUSTION ENGINES

[75] Inventor: Helmut Möder, Stuttgart, Germany

[73] Assignee: Robert Bosch G.m.b.H., Stuttgart, Germany

[22] Filed: Feb. 3, 1975

[21] Appl. No.: 546,670

[30] Foreign Application Priority Data

Mar. 2, 1974 Germany ..... 2410090

[52] U.S. Cl. ..... 123/179 L; 123/32 EA

[51] Int. Cl.[2] ..... F02B 3/00; F02D 1/04

[58] Field of Search ..... 123/32 EA, 179 L, 179 G

[56] References Cited

UNITED STATES PATENTS

| | | | |
|---|---|---|---|
| 3,616,784 | 11/1971 | Barr | 123/32 EA |
| 3,683,871 | 8/1972 | Barr et al. | 123/32 EA |
| 3,716,034 | 2/1973 | Schmid | 123/32 EA |
| 3,734,067 | 5/1973 | Glocker et al. | 123/32 EA |
| 3,741,171 | 6/1973 | Dautel | 123/32 EA |
| 3,742,920 | 7/1973 | Black | 123/32 EA |
| 3,785,353 | 1/1974 | Borisov et al. | 123/32 EA |
| 3,792,693 | 2/1974 | Luchaco | 123/32 EA |

*Primary Examiner*—Charles J. Myhre
*Assistant Examiner*—Ronald B. Cox
*Attorney, Agent, or Firm*—Edwin E. Greigg

[57] ABSTRACT

A fuel injection control apparatus provides electrical pulses whose length determines the amount of fuel supplied to the injection valves of the engine. These pulses can be extended by a circuit including a temperature dependent resistor when the engine has not reached operational temperature. This same mechanism is utilized to lengthen the fuel delivery control pulses even when the engine is warmed up, i.e., under hot-start conditions, by connecting a switching transistor in series with the temperature-dependent resistor that monitors the engine temperature. If, while the engine is hot, the starter motor is being cranked longer than a predetermined length of time, the switching transistor turns off and causes the fuel injection pulse to be lengthened, thereby supplying additional fuel to the engine to overcome a possible fuel vapor lock.

8 Claims, 1 Drawing Figure

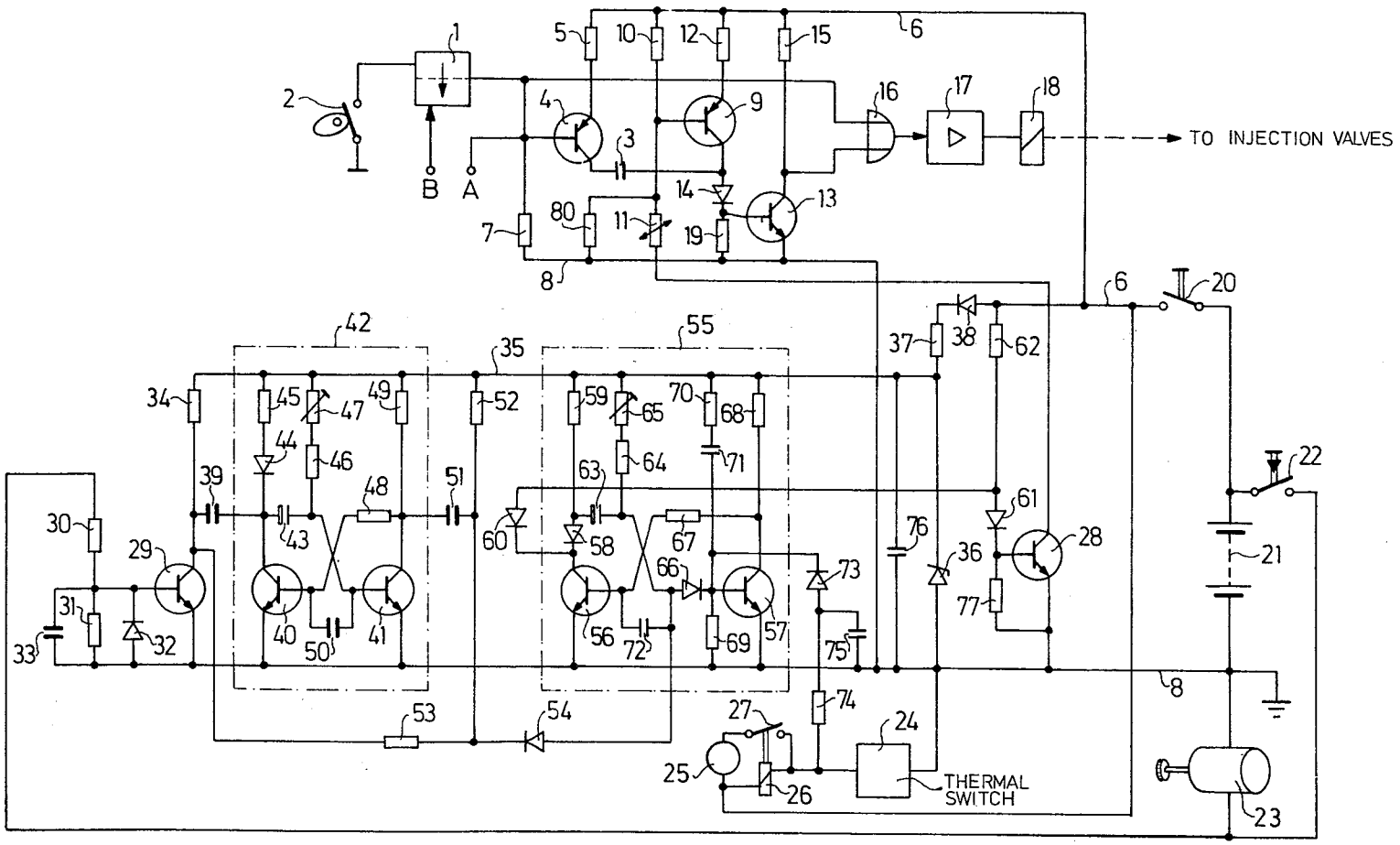
TO INJECTION VALVES
THERMAL SWITCH
A
B

CONTROL APPARATUS FOR STARTING INTERNAL COMBUSTION ENGINES

BACKGROUND OF THE INVENTION

The invention relates to a control apparatus for starting internal combustion engines, especially those employing electronically controlled fuel injection. These engines typically include a sensor for determining the engine operating temperature which serves for the temperature-dependent metering of an excess fuel quantity during cold starting and during the warm-up phase of the internal combustion engine.

Under certain conditions during the hot starting of internal combustion engines employing fuel injection, e.g., when the injection valves are overheated, fuel vapor bubbles may be formed and may cause insufficient fuel quantities to reach the internal combustion engine, thus failing to provide an ignitable fuel-air mixture.

OBJECT AND SUMMARY OF THE INVENTION

It is a principal object of the invention to provide a control apparatus which does not have the above described disadvantage and which makes possible a reliable start of the internal combustion engine under hot start conditions, i.e., when the engine is at its normal operational temperature.

This object is attained, according to the invention, in that the sensor which determines the temperature of the internal combustion engine is associated with an electronic switching circuit which, during hot starting, triggers the release of a supplementary amount of fuel if the internal combustion engine has not started to run after a predetermined time interval has elapsed.

This supplementary release of fuel creates an ignitable fuel-air mixture and also tends to cool the injection valves due to the increased fuel flow rate.

The invention will be better understood as well as further objects and advantages will become more apparent from the ensuing detailed specification of an exemplary embodiment of the invention taken in conjunction with the sole FIGURE, which is a partially schematic representation of a control apparatus and the associated electronic circuitry for the metering out of fuel under all operational conditions of the internal combustion engine.

DESCRIPTION OF THE PREFERRED EMBODIMENT

The air required for combustion in an internal combustion engine is aspirated in known manner through an induction tube containing a butterfly throttle valve which can be adjusted with the aid of a gas pedal. Also located within the induction tube, between the air filter and the throttle valve, is an air flow rate meter embodied as a baffle plate and capable of providing an electrical output signal. Associated with each cylinder of the internal combustion engine is a fuel injection valve which injects fuel into the induction tube immediately ahead of the intake valve. The actuation of the injection valves, i.e., the determination of the opening time of the injection valve is controlled by a control circuit to be described below. The control circuit employs a monostable main multivibrator 1 triggered by a pulse generator 2. The pulse generator 2 is a cam-actuated switch. The pulse generator 2 is closed in synchronism with the rotation of the crank shaft in such a manner that each injection valve receives an injection control pulse at every other crank shaft revolution. A corrective input signal B changes the pulse duration of the monostable main multivibrator 1 in dependence on the measured air quantity, so that when the air quantity increases, the injected fuel quantity also increases.

Connected to the output of the monostable multivibrator 1 is a pulse extension stage containing a storage capacitor 3. One of the leads of the storage capacitor 3 is connected to the collector of a transistor 4 whose emitter is connected via a resistor 5 to the positive supply voltage line 6 and whose base is connected directly to the output of the monostable main multivibrator 1. The base of transistor 4 is also connected via a resistor 7 to the common ground line 8.

The second lead of the storage capacitor 3 is connected to the collector of a discharge control transistor 9. The base of the discharge control transistor 9 is connected to a voltage divider circuit consisting of a resistor 10, a resistor 80 and a variable resistor 11. The emitter of the discharge transistor 9 is connected via a resistor 12 to the positive supply line 6. A diode 14 is connected between the collector of the discharge transistor 9 and the base of an inverting transistor 13 and its polarity is such that it permits passage of the collector current of the discharge transistor 9. The base of the inverting transistor 13 is connected through a resistance 19 with the ground line 8. A collector resistor 15 is connected between the collector of the inverter transistor 13 and the positive supply line 6.

The output of the monostable main multivibrator 1 is connected to one input of an OR gate 16 and the collector of the inverting transistor 13 is connected to a second input of the OR gate 16. The output of the OR gate 16 is fed to a control amplifier 17 which controls the magnetic windings 8 serving for the actuation of the injection valves.

The overall method of functioning of the above described control circuit is known from other electronically controlled gasoline injection systems, for example from that described in the German Auslegeschrift No. 1,526,506. Hence, it will be described only briefly. As mentioned above, the length of the output pulses of the monostable main multivibrator 1 depends on the air quantity flowing in the induction tube, but it can also be made dependent on other operational parameters of the internal combustion engine, for example on the induction tube vacuum. The output pulse from the monostable main multivibrator 1 is fed to the OR gate 16 and thence directly to the control amplifier 17. This output pulse is followed by an extension pulse which is formed in the pulse extender circuit containing the transistors 4 and 9. The length of the extension pulse is proportional to the duration of the output pulse of the monostable main multivibrator 1. The length of the extension pulse is also influenced by the variable resistor 11 which may, for example, be embodied as a resistor with a negative temperature coefficient, and this resistor 11 measures the engine temperature. In this way, a supplementary excess fuel quantity may be supplied to the engine during cold starting and during the warm-up phase of the engine. Any change in the value of the resistance of the resistor 11 influences the discharge current of the capacitor 3 and hence affects the time at which the inverting transistor again becomes conducting subsequent to an initial turn-off.

The base electrodes of the two transistors 3 and 9 may be supplied with additional correction voltages.

In steady state conditions, the inverting transistor 9 conducts. The transistor 13 can be turned off when a negative pulse is passed by the capacitor 3. In that case, the signal at the collector of transistor 13 as well as the output signal of the monostable main multivibrator 1 is an L-type signal, i.e., it is equal to the voltage of the positive voltage supply line 6. The output of the OR gate 16 is also an L-type signal if at least one L-type signal is present at its input. Thus, the output pulse of the pulse extender circuit is juxtaposed temporally to the output pulse of the monostable main multivibrator 1.

The positive voltage supply line 6 is connected through an ignition switch 20 to the positive terminal of a storage battery 21. The negative terminal of the battery 21 is connected to ground 8. The positive terminal of the battery is also connected to a starter switch 22 which, when closed, connects a starting motor 23 with the positive terminal of the battery 21 for cranking the engine.

Located within the cooling water of the internal combustion engine, or at some other appropriate place, is a temperature-dependent switch 24 which is often used, for example, for turning on a supplementary fan motor 25 when the engine becomes extremely hot. For this purpose, one lead of the temperature-dependent switch 24 is connected to the ground 8 and the other lead to the windings 26 of a relay which has a contact 27 that can turn on the blower motor 25. At the same time, the temperature-dependent switch 24 is used to characterize the case when the internal combustion engine is being hot-started; thus, when the temperature-dependent switch 24 is closed, the engine conditions are those of a hot start whereas, when the temperature-dependent switch 24 is open, the temperatures of the internal combustion engine lie below those of a hot start.

Now it is intended, according to the invention, that if the temperature-dependent switch 24 is closed, and if the starter motor is being operated longer than a predetermined time interval, then the injection process is to be continued for a certain length of time beginning with the expiration of the predetermined time interval.

For this purpose a switch, embodied in this case as a second switching transistor 28, is connected in series with the temperature dependent NTC resistor 11 so that, when the conditions of a hot start are present, the switching transistor 28 is turned off for a predetermined duration although, in normal engine operation, it must always be conducting. When the switching transistor 28 is turned off, the above-described control circuit is provided with a simulated, very low engine temperature which leads to an extension of the fuel injection control pulses.

The electronic control circuit which actuates the switching transistor 28 will now be described:

The control electrode of a first switching transistor 29 is connected to a base voltage divider 30, 31 and thence to the starter switch 22. A diode 32 and a capacitor 33 are connected in parallel with the base-emitter section of the first switching transistor 29. The collector of the first switching transistor 29 is connected through a resistor 34 with a common supply line 35 which supplies the control circuit with a voltage stabilized by a Zener diode 36. One side of the Zener diode 36 is connected to the ground 8 and the other side is connected through a resistor 37 and a diode 38 with the positive supply line 6. The first electrode of a capacitor 39 is connected to the junction of the resistor 34 and the collector of the transistor 29. The second electrode of the capacitor 39 is connected to the collector of a transistor 40 which, together with a transistor 41, belongs to a first monostable multivibrator circuit 42. The collector of transistor 40 is connected to a capacitor 43 whose other side is connected to the base of the transistor 41. Also connected to the collector of transistor 40 is a diode 44, in series with a resistor 45 connected to the common supply line 35. The base of transistor 41 is connected via resistors 46 and 47 to the common supply line 35 and the base of transistor 40 is connected to a resistor 48 whose one side is connected to the collector of the transistor 41 and whose other side is connected to a further resistor 49. The resistor 49 is connected to the common supply line 35. A capacitor 50 is connected between the bases of transistors 40 and 41.

Connected to the output of the first monostable multivibrator circuit 42, i.e., to the collector of transistor 41, is one lead of a capacitor 51 whose other lead is connected to a resistor 52, a resistor 53 and the cathode side of a diode 54. The resistor 53, the resistor 52 and the diode 54 together form an AND gate.

The anode side of the diode 54 is connected to the triggering input of a second monostable multivibrator circuit 55, suggested in the FIGURE by a dash-dot border. The second monostable multivibrator includes a transistor 56 and a transistor 57 whose emitters are connected to the ground line 8. The collector of the transistor 56 is connected through a diode 58 and a resistor 59 to the common supply line 35. The collector of transistor 56 is connected to the cathode side of a diode 60 whose anode is connected to the anode side of a diode 61 whose own cathode, in turn, is connected to the base of the second switching transistor 28. The anode side of the diode 61 is also connected to a resistor 62 whose other lead is connected to the positive supply line 6. A capacitor 63 is connected between the anode of the diode 58 and the resistor 64.

The resistor 65 is connected to the common power supply line 35. The capacitor 63 is also connected to the anode side of a diode 66 whose cathode is connected to the base of the transistor 57. The base of the transistor 56 is connected to a resistor 67 whose other side leads to the collector of the transistor 57 which is also connected to the positive supply line 35 through a load resistor 68. The base of the transistor 57 is connected to a base voltage divider consisting of resistors 69 and 70 and including a capacitor 71. A capacitor 72 is connected between the two bases of transistors 56 and 57. Connected to the base of transistor 57 is a diode 73 whose anode is connected to the temperature-dependent switch 24 through a resistor 74. The anode of the diode 73 is grounded through a capacitor 75. A filter capacitor 76 is connected in parallel with the Zener diode 36. A resistor 77 is connected in parallel with the base-emitter section of the switching transistor 28.

The method of operation of the control circuit described above is as follows:

Closing the ignition switch 20 serves to connect the control apparatus to the battery 21 serving as the operational power source. The first monostable multivibrator and the second monostable multivibrator immediately switch to their stable states in which the transistor 41 is made conducting through the resistor 34 as well as the capacitor 39 and the capacitor 43. The transistor 57 is made conducting through the resistor 70 and the capacitor 71. When the starting switch 22 is closed and the starter motor 23 begins to rotate, the first switching transistor 29 is switched over into its conducting state and the negative voltage pulse produced at its collector triggers the first monostable multivibrator. This multivibrator switches over into its unstable state in which the transistor 41 is blocked and the transistor 40 becomes conductive. The capacitor 43 becomes oppositely charged through the resistors 46 and 47 until such time as the monostable multivibrator 42 switches back into its stable state. If, at this time, the engine starting process has not yet been completed, i.e., the starting switch 22 is still closed, the the transistor 29 still conducts. Thus, a negative voltage pulse which occurs when the transistor 41 switches back from the non-conducting to the conducting state is transmitted through the capacitor 51 and the diode 54 to the base of the transistor 57 in the second monostable multivibrator 55. As a result, the second monostable multivibrator 55 switches over into its unstable state in which the transistor 56 conducts and the transistor 57 blocks. When the transistor 56 conducts, the diode 60 also conducts and a negative signal reaches the base of the second switching transistor 28 which therefore turns off. Whenever the switching transistor 28 is turned off, the discharge control transistor 9 and the associated circuitry is presented with a simulated low engine temperature which leads to a pronounced extension of the length of the normal injection pulse. When the second monostable multivibrator 55 switches back into its stable state, the switching transistor 28 immediately becomes conducting and the extension pulse which is produced by the control circuit including the discharge transistor 9 is then terminated. Since it is desired that the described process take place only when hot start conditions prevail, care must be taken that the second switching transistor 28 can be turned off only under hot start conditions. This can be insured in that the second monostable multivibrator 55 can be switched over into its unstable switching state only if the temperature-dependent switch 24 is closed, i.e., if the internal combustion engine and hence also the injection valves are really very hot, for, in this case, the diode 73 is blocked because its anode carries a negative voltage so that the switchover of the monostable multivibrator 55 to the unstable state cannot be prevented. On the other hand, if the temperature-dependent switch 24 is open, i.e. if the conditions of a hot start do not prevail, then a positive voltage is transmitted through the relay windings 26 to the base of the transistor 57 which is therefore kept conducting and cannot be switched over into its unstable, non-conducting state.

It is intended that the second monostable multivibrator 55 is triggered only if the starting switch 22 is still being actuated when the first monostable multivibrator switches back from its unstable state into its stable state, i.e., if, at that time, the engine starting process has not yet been completed. By contrast, if, at the time when the first monostable multivibrator switches back from its unstable state to its stable state, the starting switch 22 is already open again, i.e., the engine starting process has been terminated, then the transistor 29 blocks and the capacitor 51 is at a positive potential through the resistor 34, the resistor 53 and through the resistor 52. For this reason, the negative voltage pulse which occurs at the collector of the transistor 41 when this transistor switches from the conducting state to the non-conducting state is without effect, i.e., this negative voltage pulse is insufficient to pass the diode 54 and to provide a negative triggering pulse to the second monostable multivibrator 55.

Thus, the described circuit insures that, when hot-start conditions prevail, the series connection of the second switching transistor 28 and the NTC resistor 11 simulates a very low engine temperature which results in providing a long extension pulse and hence in supplying a supplementary excess fuel quantity to the engine under hot-start conditions.

The function of some of the individual elements in the control apparatus is further described as follows. In known manner, the capacitor 33 serves for suppressing extraneous voltages and the diode 32 is intended to protect the base of transistor 29 from voltage peaks which occur when the starting motor 23 is turned off. The diode 60 serves for uncoupling the switching transistor 28 from the monostable multivibrator 55 and the diode 58 has the function of forcing an abrupt positive voltage to occur at the collector of the transistor 56 when it blocks so that the voltage does not rise to the positive supply value with the time constant which would result from the combination of resistor 59 and capacitor 63. Furthermore, this connection results in a very steep turn-on ramp of the switching transistor 28. Finally, the diode 58 prevents the capacitor 63 from charging to a higher voltage than the Zener voltage of the diode 36 even though a higher voltage than the Zener voltage of the Zener diode 36 may be present at the anode of the diode 61.

In known manner, the diode 73 and the capacitor 75 serve for the removal of extraneous voltage pulses and the diode 61 compensates for the conduction potential of the diode 60 so that, when the transistor 56 switches on, the switching transistor 28 can be reliably blocked. Finally, the diode 38 in the positive supply line 6 serves to prevent inverse polarity and is intended to protect the apparatus from destruction or damage during any unintentional erroneous connection.

It is also intended to protect the apparatus from short-term voltage surges.

What is claimed is:

1. In a starting control apparatus of an internal combustion engine with especially electronically controlled fuel injection, said engine including an electric starter motor, a starting switch, fuel injection valves, said control apparatus including electronic circuit means for controlling the injection valves of the engine and further including an engine temperature sensor for providing an electrical signal to said circuit means for controlling the fuel injection process, the improvement comprising:

an electronic switch, connected in series with said temperature sensor for altering the electrical signal provided by said temperature sensor; and a thermal switch, connected to operate said electronic switch; whereby said electronic switch causes the release of supplementary fuel to the internal combustion engine when said engine is at normal operating temperature, and said starter motor has been actuated for more than a predeterminded time.

2. A control apparatus as defined in claim 1, the improvement further comprising:

c. a first monostable multivibrator circuit, connected to the starter switch of the engine so as to be capable of a change of state due to the actuation of said starter switch;

d. a second monostable multivibrator circuit, connected to said first monostable multivibrator circuit so as to be capable of a change of state as a result of a change of state of said first monostable multivibrator circuit;

whereby said second monostable multivibrator circuit can actuate said electronic switch if said thermal switch indicates that the engine is at normal operating temperature.

3. A control apparatus as defined in claim 2, wherein said first monostable multivibrator circuit and said second monostable multivibrator circuit contain electrical elements which insure that each of said circuits assumes its stable state when the electric operating potential is applied to said circuits.

4. A control apparatus as defined in claim 2, the improvement further comprising:

e. a first switching transistor, connected to said first monostable multivibrator circuit and to the starter switch of the engine, and capable of triggering a change of state of said first monostable multivibrator circuit; and f. a network of resistors and diodes forming a logical AND circuit, connected between said first monostable multivibrator circuit and said second monostable multivibrator circuit, and capable of triggering a change of state of said second monostable multivibrator circuit.

5. A control apparatus as defined in claim 4, wherein said thermal switch is connected with said second monostable multivibrator circuit to prevent said second monostable multivibrator circuit from assuming its unstable state.

6. A control apparatus as defined in claim 4, wherein said second monostable multivibrator is connected to said electronic switch to control its operation.

7. A control apparatus as defined in claim 6, wherein said electronic switch is a second switching transistor whose control electrode is connected to the output of said second monostable multivibrator circuit.

8. A control apparatus as defined in claim 7, wherein said control electrode of said second switching transistor is connected to the output of said second monostable multivibrator circuit through two diodes.

* * * * *